US007258030B2

(12) United States Patent
McCallum

(10) Patent No.: US 7,258,030 B2
(45) Date of Patent: Aug. 21, 2007

(54) FAILSAFE ELEMENT FOR ROTARY CAM UNIT USED IN A FLANGED DIE

(75) Inventor: Scott McCallum, St. Clair, MI (US)

(73) Assignee: Syron Engineering & Manufacturing, LLC, Saline, MI (US)

( * ) Notice: Subject to any disclaimer, the term of this patent is extended or adjusted under 35 U.S.C. 154(b) by 610 days.

(21) Appl. No.: 10/758,814

(22) Filed: Jan. 16, 2004

(65) Prior Publication Data

US 2004/0163489 A1 Aug. 26, 2004

Related U.S. Application Data

(60) Provisional application No. 60/441,329, filed on Jan. 21, 2003.

(51) Int. Cl.
*F16H 29/00* (2006.01)

(52) U.S. Cl. ..... 74/122

(58) Field of Classification Search ..... 74/111, 74/116, 122, 125, 567, 569; 72/380, 381
See application file for complete search history.

(56) References Cited

U.S. PATENT DOCUMENTS 4,356,716 A * 11/1982 Aschauer ..... 72/322
4,411,148 A * 10/1983 Aschauer et al. ..... 72/306
4,843,862 A * 7/1989 Salvagnini ..... 72/319
5,101,705 A 4/1992 Matsuoka
5,784,916 A 7/1998 Matsuoka
6,196,040 B1 3/2001 Matsuoka
6,263,717 B1 * 7/2001 Nojiri ..... 72/313
6,470,727 B1 * 10/2002 Kunze ..... 72/323
6,519,995 B2 2/2003 Matsuoka
6,526,797 B2 3/2003 Matsuoka
6,539,766 B2 4/2003 Matsuoka
6,619,095 B2 9/2003 Matsuoka
7,114,360 B2 * 10/2006 Ikeda ..... 72/306

FOREIGN PATENT DOCUMENTS

JP 2004322167 A * 11/2004
JP 2006116558 A * 5/2006

* cited by examiner

*Primary Examiner*—Vicky A. Johnson
(74) *Attorney, Agent, or Firm*—Carlson, Gaskey & Olds

(57) ABSTRACT

A rotary cam assembly for a bending die includes first and second arms pivotally attached to an actuator. Linear movement of the actuator causes rotation of the rotary cam relative to a bending cam. A rotatable element is supported between the first and second arms and guides along a cam surface of a fail-safe element mounted on an upper die. In the absence of actuator movement, the fail-safe element cause rotation of the rotary cam from a released position to a bending position ensuring proper position of the rotary cam relative to a bending cam.

21 Claims, 5 Drawing Sheets

FAILSAFE ELEMENT FOR ROTARY CAM UNIT USED IN A FLANGED DIE

This application claims priority to U.S. Provisional Application Ser. No. 60/441,329 filed on Jan. 21, 2003.

BACKGROUND OF THE INVENTION

This invention relates generally to a rotary cam for a bending die, and specifically to a failsafe device for properly positioning the rotary cam.

Bending dies are known in the art that produce negative angles in a sheet metal work piece. A negative angle is an angle in the work piece that cannot be formed by the simple vertical movement of the upper die portion. In order to produce the negative angle a rotary cam is used in concert with a bending cam. The rotary cam moves into position such that the bending cam can bend the work piece. After the desired forming of the work piece, the rotary cam is rotated to a release position to allow removal of the work piece.

Typically, a pneumatic actuator is utilized to move the rotary cam between bending and released positions. If the rotary cam is not in the proper position as the bending die is closed undesirable contact between the bending cam and the rotary cam can occur.

It is known to provide a failsafe element to prevent contact between the bending cam and the rotary cam. Such fails safe elements include a cantilever-mounted roller on the rotary cam. The roller engages a cam surface moving with the driven die portion to move the rotary cam to the bending position. The cam surface and moving die portion are usually driven at a high speed. The high speed causes high forces upon contact between the roller and the cam surface. The cantilevered roller is often damaged due to the high forces between the roller and the cam surface.

Accordingly, it is desirable to design a dependable and durable rotary cam failsafe device for properly positioning the rotary cam of a bending die.

SUMMARY OF THE INVENTION

This invention is a rotary cam assembly including a failsafe device that moves the rotary cam assembly to a proper bending position relative to a bending cam.

The rotary cam assembly of this invention includes first and second arms pivotally attached to a primary actuator. Each of the first and second arms include a first segment attached to the primary actuator and pivots with the rotary cam. Actuation of the primary actuator causes rotation of the rotary cam into the desired bending position. Each of the first and second arms also includes a second segment that supports a rotatable element. The rotatable element is supported on a shaft supported at each end by one of the first and second arms This invention includes a second actuator supported on the driven die portion. The second actuator acts on the rotatable element to bias the first and second arms and thereby the rotary cam towards the engaged position. The primary actuator overcomes the biasing force of the second actuator to release the work piece. In the event that the primary actuator is inoperable the biasing force provided by the second actuator provides for rotation of the rotary cam to the bending position.

Another fail-safe assembly according to this invention includes a knife plate that moves with the driven die portion of the bending die. The knife plate includes a cam surface that engages the roller during the closing stroke of the bending die. If the primary actuator has not already moved the rotary cam, engagement between the roller and the cam surface causes movement of the rotary cam to a position that does not cause contact between the rotary cam and the bending cam. The cam surface includes an angle that converts linear motion of the knife plate to rotary motion of the rotary cam. The angle of the cam surface is configured to minimize the impact on the roller caused by the high speed at which the knife plate is driven.

Accordingly, the rotary cam of this invention includes a fail-safe device that is dependable and durable for providing movement of the rotary cam assembly to proper position in the event of primary actuator failure.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
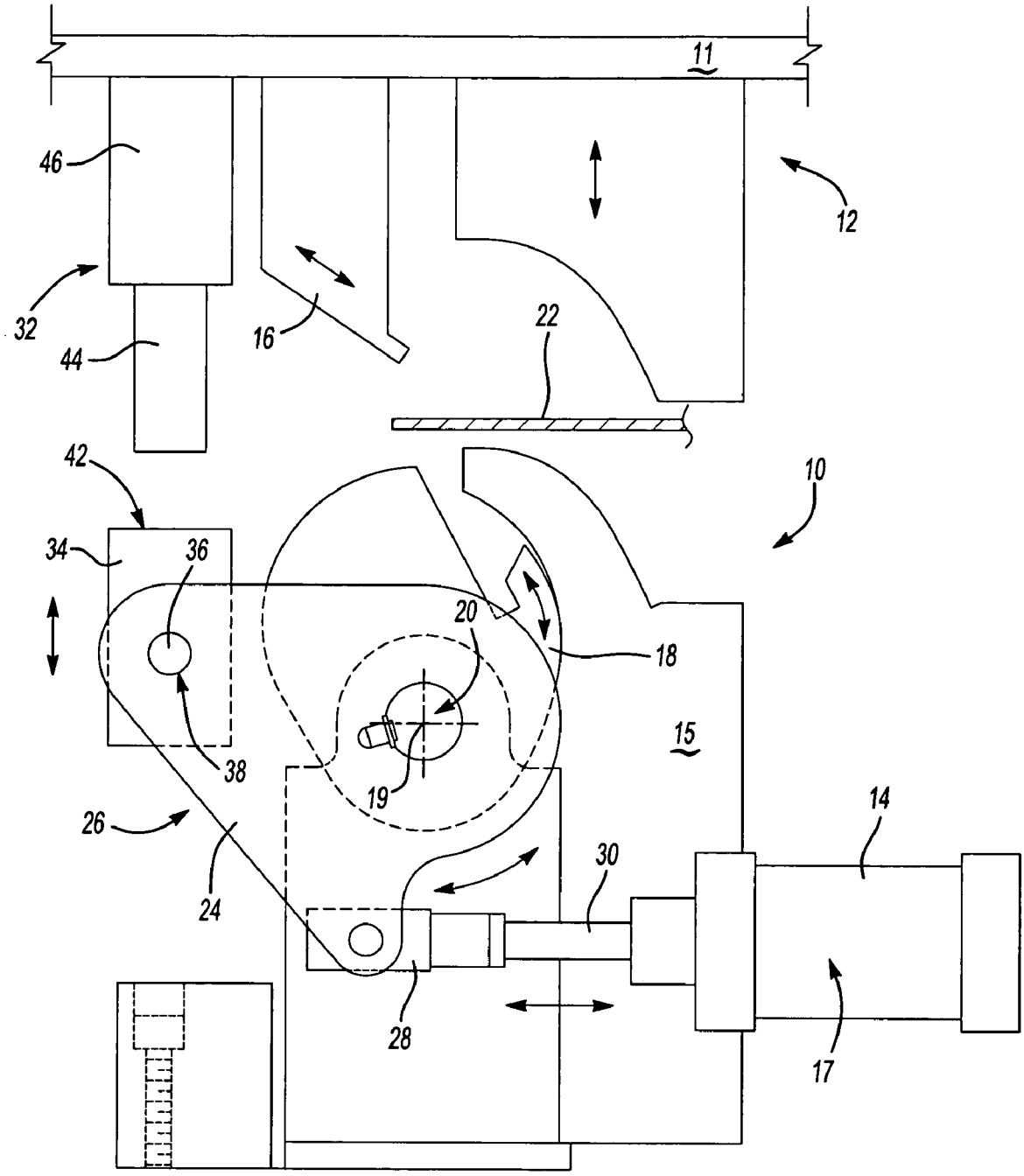
FIG. 1 is a side view of a rotary cam assembly according to this invention.

Referring to FIG. 1, a rotary cam assembly 10 for a bending die 12 includes a primary actuator 14 driving a camshaft 20. A bending cam 16 is retracted and a rotary cam 18 is rotated to allow removal of a workpiece 22. The camshaft 20 drives rotation of the rotary cam member 18 about an axis 19 for bending negative angles into a workpiece 22. The rotary cam member 18 cooperates with the bending cam 16 to provide the desired negative angle bend. First and second arms 24,26 (Best shown in FIG. 3) are attached to rotate the camshaft 20. At least one of the first and second arms 24,26 is pivotally attached to an attachment member 28 mounted on a lineally driven shaft 30 of the primary actuator 14. The configuration of the first and second arms 24,26 provide for the conversion of linear movement of the primary actuator 14 to provide the required rotation of the camshaft 20 to move the rotary cam member 18 between the engaged and disengaged positions.

The primary actuator 14 is preferably a pneumatic cylinder controlled to move the rotary cam member 18 between bending and released positions. Although, preferably a pneumatic cylinder is utilized, other actuators providing for the rotational movement of the camshaft 20 are within the contemplation of this invention. Movement of the driven shaft 30 of the primary actuator 14 is coordinated with movement of the bending cam 16 to properly position the rotary cam member 18 during a bending operation.

If the primary actuator 14 does not properly position the rotary cam member 18, an interference condition between the rotary cam member 18 and the bending cam 16 can result. Such a condition can result in undesirable contact between the rotary cam member 18 and the bending cam 16. The rotary cam assembly 10 of this invention includes a secondary actuator 32.

The second actuator 32 is in contact with a rotatable element 34 that is pivotally supported about a pivot pin 36. The pivot pin 36 includes first and second ends 38,40. Each of the pivot pin ends 38,40 are supported by one of the first and second arms 24,26. Preferably, the rotatable element 34 is rectangular and includes a face 42 contacting a shaft 44 of the secondary actuator 32. The shaft 44 of the secondary actuator 32 exerts a biasing force on the rotatable element 34 to cause movement of the camshaft 20 toward the bending position. Preferably, the secondary actuator 32 is a gas cylinder utilizing nitrogen to move the shaft linearly against the face 42 of the rotatable element 34.

The bending die assembly 12 includes a movable portion 11 driven and a static portion 15. The movable portion 11 is driven between a closed position engaged with the static portion 15 and an open position spaced apart from the static portion 15. In the open position, a workpiece 22 can be removed from the bending die assembly 12. The bending cam 16 is disposed on the movable portion 11 and moves in concert with the rotary cam member 18 to form the desired bend in the workpiece 22.

The secondary actuator 32 is mounted to the movable portion 11 of the bending die assembly 12. The secondary actuator 32 operates independent of movement of the bending cam 16 and the rotary cam member 18. In other words, the secondary actuator 32 will always engage the face 42 of the rotatable element 34 to bias the rotary cam member 18 toward the bending position regardless of the condition of any of the other elements. As appreciated, the various moving parts of the bending die assembly 12 are controlled to orchestrate movement and perform the desired bending operation. Control of the secondary actuator 32 is separately controlled from the primary actuator 14, and any of the other moving components, such as the bending cam 16, and the movable die portion 11. The independent and separate movement of the secondary actuator 32 provide for actuation and movement of the rotary cam member 18, even if all other functions of the bending die 12 are not operating properly. This prevents undesirable contact between the bending cam 16 and the rotary cam member 18, regardless of failures in other parts of the bending die assembly 12.

FIG. 1, illustrates the rotary cam member 18 in the released position, where the workpiece 22 can be removed. The bending cam 16 is in a retracted position and the movable die portion 11 is spaced apart from the static die portion 15 in the open position. In the open position, the workpiece 22 can be removed after being formed, and a new workpiece 22 placed within the bending die 12 for forming. The secondary actuator 32 is moved upward with the movable die portion 11 and spaced apart from the rotatable element 34. The shaft of the secondary actuator 32 is extended by the biasing energy provided by the contents of the cylinder 46.

The primary actuator 14 is shown with the linear shaft 30 driven outward from the pneumatic cylinder 17 to rotate the first and second arms 24,26, and thereby the camshaft 20, and the rotary cam member 18 to the released position. During the desired operation, the primary actuator 14 will provide for the movement to the released position. However, if the primary actuator 14 were not operating as desired, the rotary cam member 18 would not move to the released position and the workpiece 22 could not be removed.

Figure 2:
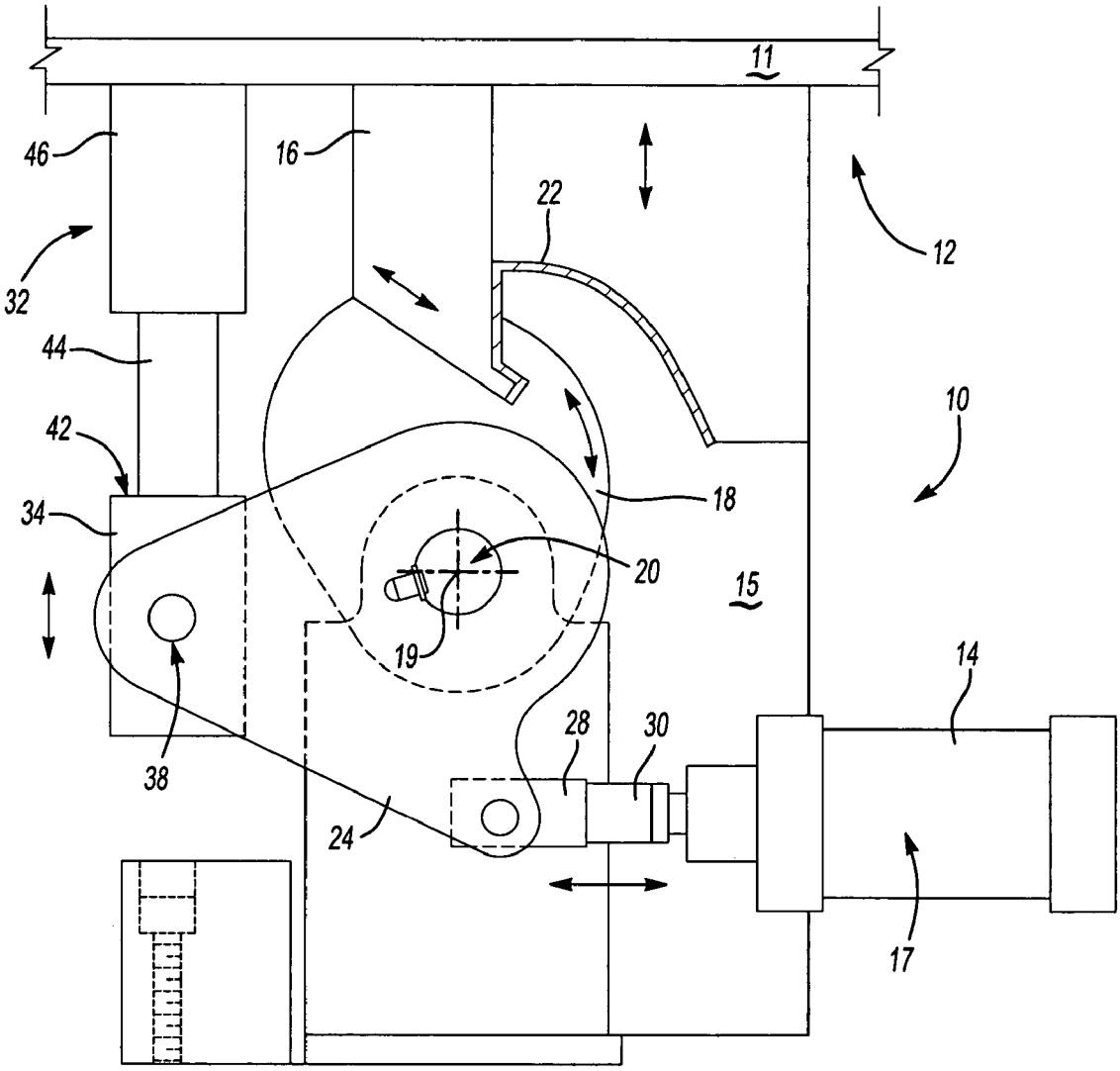
FIG. 2 is a side view of the rotary cam assembly in a bending position.

Referring to FIG. 2, the rotary cam member 18 and bending cam 16 are shown in the bending position. In this position, a portion of the bending cam 16 is received within a portion of the rotary cam member 18. As appreciated, movement of the bending cam 16 to the bending position absent proper corresponding movement of the rotary cam member 18 could result in undesirable contact. The shaft 44 of the secondary actuator 32 contacts the face of the rotatable element 34 and drives the camshaft 20 and the rotary cam member 18 to the bending position.

During normal operation, the primary actuator 14 moves the camshaft 20 by way of the first and second arms 24,26, and thereby rotates the rotary cam member 18 to the proper bending position. However, if for the primary actuator 14 becomes inoperable, the secondary actuator 32 provides the required biasing force to move the rotary cam member 18 to the bending position. Once the bending operation is complete, however, because the primary actuator 14 is not operating, the rotary cam member 18 remains in the bending position. Preferably, the secondary actuator 32 operates only to move the rotary cam member 18 to the released position. Upon a bending operation in which the primary actuator 14 does not rotate the rotary cam member 18 to a release position, the workpiece 22 cannot be removed, and remedial action is taken to correct to the operation of the primary actuator 14.

Figure 3:
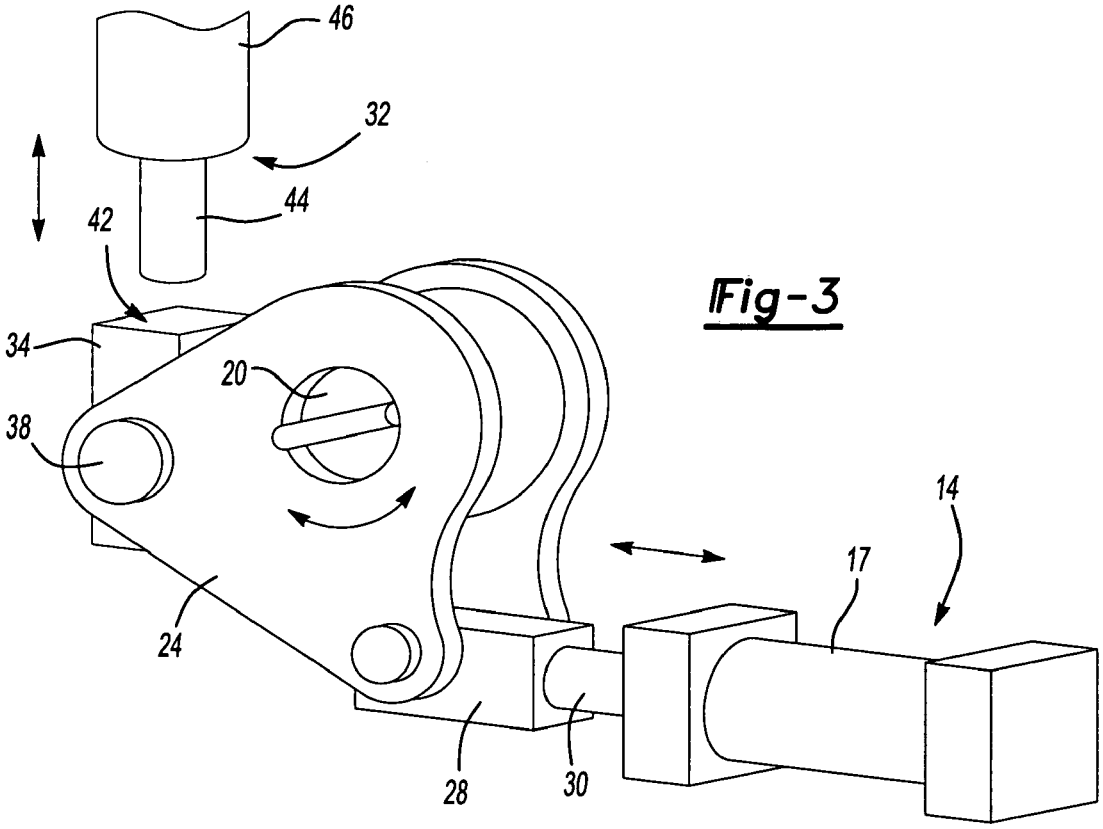
FIG. 3 is a perspective view of the rotary cam assembly.

Referring to FIG. 3, a perspective view of a rotary cam assembly 10 is shown. In this view, the rotatable element 34 can be seen more clearly suspended and supported between the first and second arms 24,26. The primary actuator 14 moves the first and second arms 24,26, thereby causing rotation of the camshaft 20. The shaft 44 of the second actuator engages the rotatable element 44. As appreciated, the specific shape of the pivotal element can take on many forms, including a block as shown, a roller, a pin or other known shapes as are known to a worker skilled in the art. Other configurations of pivotal elements supported by first and second arms 24,26 as would provide for the transmission of linear force provided by the secondary actuator 32 to rotate the camshaft 20 are within the contemplation of this invention.

Figure 4:
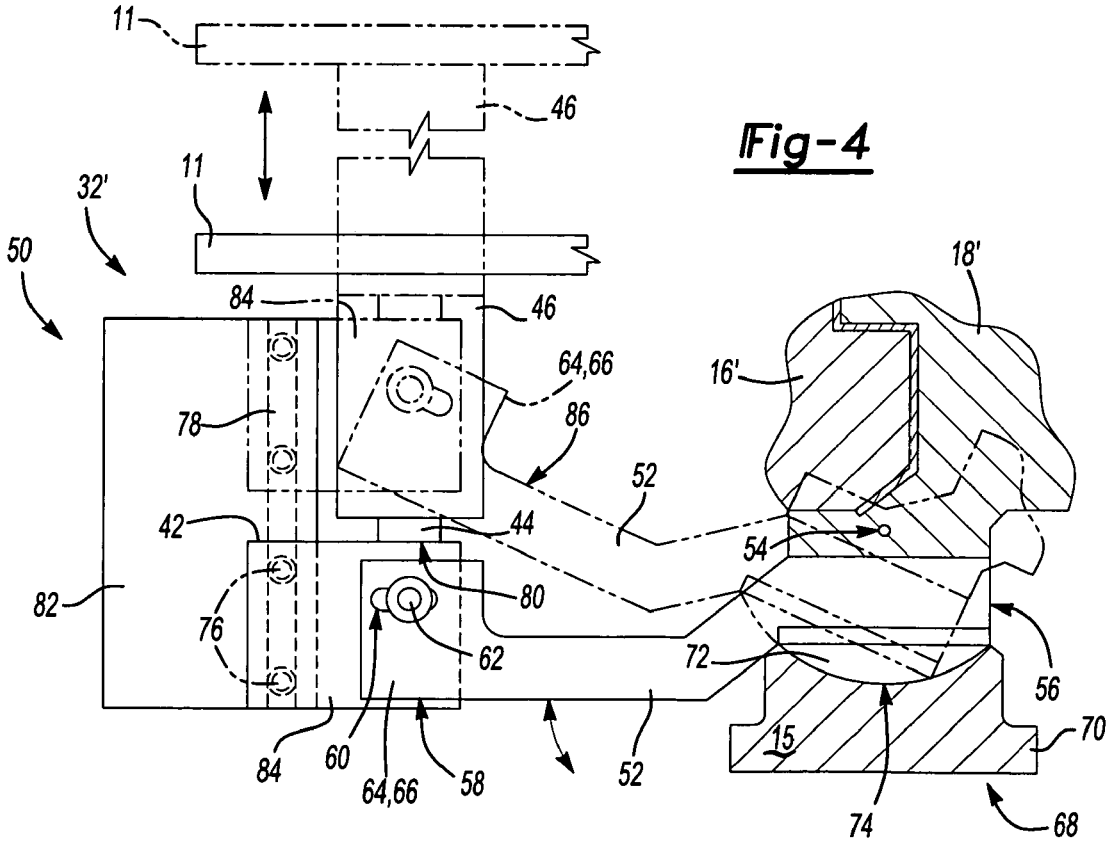
FIG. 4 is a side view of another rotary cam assembly according to this invention.

Referring to FIG. 4, another rotary cam assembly 50 according to this invention is shown and includes an arm 52. Movement of the arm 52 about an axis 54 rotates the rotary cam member 18' in concert with the bending cam 16' between the released and bending positions. The arm 52 includes a first end 56 mounted to the moving portion to rotate the arm about the axis 54. A second end of the arm 58 includes a longitudinal slot 60. Within the longitudinal slot 60 is a pin 62 supporting a rotatable element 84.

Figure 5:
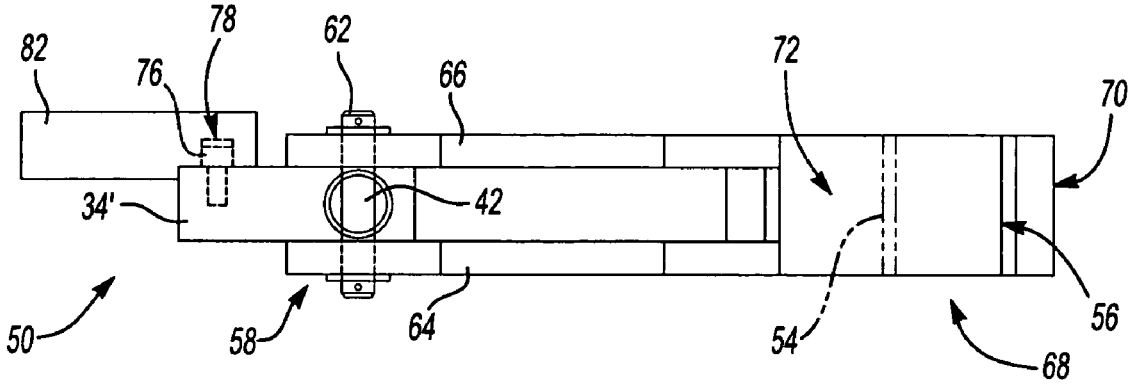
FIG. 5 is a top view of the rotary cam assembly shown in FIG. 4.

Referring to FIG. 5, the second end 58 of the arm 52 includes first and second parallel fingers 64,66. The rotatable element 84 is supported between the fingers 64,66. The pin 62 provides for longitudinal movement of the rotatable element 34. Rotation of the arm 52 about the axis 54 includes a longitudinal component. The slot 60 accommodates the longitudinal component to maintain correct alignment between the face 80 of the rotatable element 84 and the secondary actuator 32'.

Figure 6:
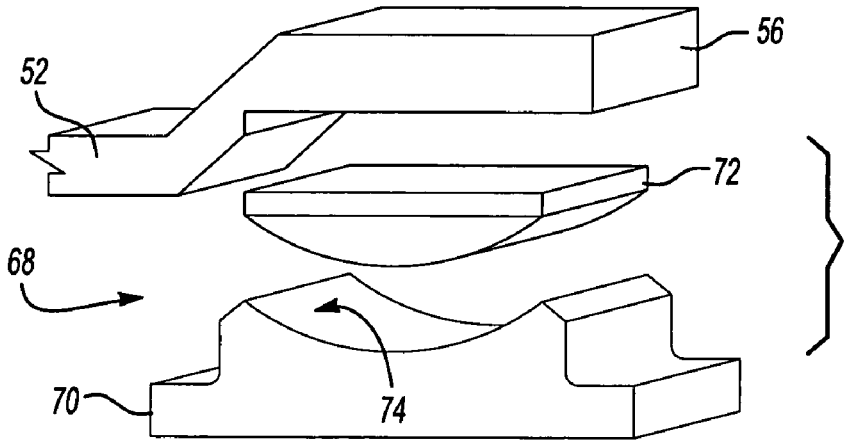
FIG. 6 is a perspective view of the radial mount for the rotary cam assembly shown in FIGS. 4 and 5.

Referring to FIG. 6, the arm 52 is supported on a radial mount 68. The radial mount 68 includes a base portion 70 and a movable portion 72. The movable portion 72 rotates along a surface 74 of the base portion 70 to rotate the arm 52 about an axis 54. The configuration of the radial mount 68 supports and rotates the rotary cam member 18' without a camshaft 20.

Referring to FIGS. 4 and 5, the secondary actuator 32' biases the rotary cam member 18' toward the bending position by exerting a biasing force on the rotatable element 84 that in turn causes rotation of arm 52. The secondary actuator 32' preferably includes the shaft 44 that is extended from the cylinder 46. Preferably the cylinder 46 utilizes nitrogen to provide the biasing force. Further, the secondary actuator 32' operates independent of the other movable components of the bending die assembly 12.

The rotatable element 84 moves linearly vertically and is guided by guide balls 76 within a guide slot 78. The guide balls 76 and slot 78 combine to maintain the face 42 of the rotatable element 84 perpendicular to the shaft 44 of the secondary actuator 32'. Radial movement of the arm 52 results in vertical movement of the rotatable element 84. The rotatable element 84 rotates relative to the arm 52, but does not rotate relative to the guide slot 78. Maintaining the vertical orientation of the rotatable element 84 relative to the secondary actuator 32' ensures proper engagement and transmission of biasing force to rotate the rotary cam member 18'.

In operation, the arm 52 begins in the released position, as indicated at 86. The movable die portion 11 moves toward the closed position. As the movable die portion 11 moves toward the static die portion 15, the secondary actuator 32' engages the face 80 of the rotatable element 84. Continued movement drives the arm 52 downward. The biasing force of the secondary actuator 32' moves the rotatable element 84 downward, which in turn causes the arm 52 to rotate about the axis 54. Rotation of the arm 52 causes rotation of the rotary cam member 18' into the bending position. Even in the absence of primary actuator 14 movement, the rotary cam member 18' is ensured to be in the desired bending position and prevent undesirable contact between the bending cam 16' and the rotary cam member 18'.

Figure 7:
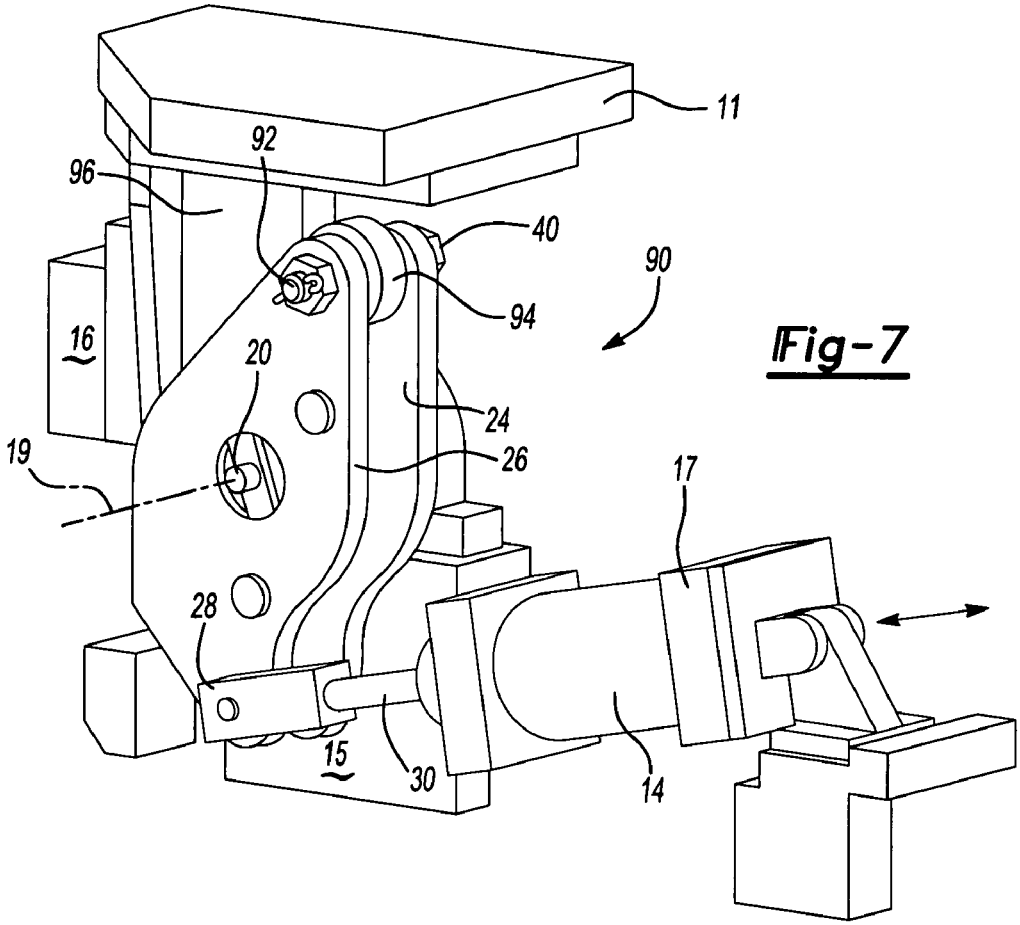
FIG. 7 is a perspective view of another rotary cam assembly according to this invention.

Referring to FIG. 7, another rotary cam assembly 90 according to this invention includes a shaft 92 supporting a roller 94 between the first and second arms 24,26. The first and second arms 24,26 are attached to rotate the camshaft 20. The roller 94 engages a knife plate 96 that is moveable with the movable die portion 11. The knife plate 96 is shown engaged with the roller 94 such that the rotary cam 16 is in the bending position.

Figure 8:
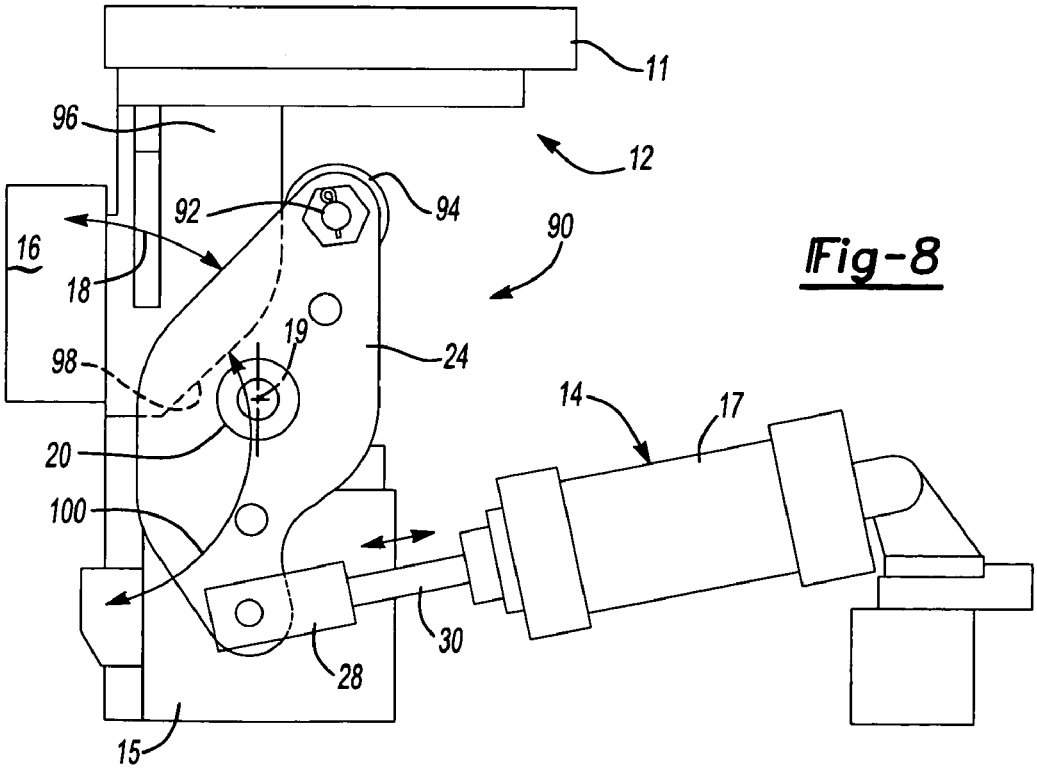
FIG. 8 is a side view of the rotary cam assembly shown in FIG. 7.

Referring to FIG. 8, a cam surface 98 defined on the knife plate 96 includes an angle 100 that provides for a smooth transition between the released and bending positions. During operation, the movable die portion 11 is moved downward at a significant speed. This significant speed creates large forces on the roller 94. This force is exerted on the roller 94 and the shaft 92 that supports the roller 94 between the first and second arms 24,26. The angle 100 of the cam surface 98 accommodates not only movement of the first and second arms 24,26 but also eases the impact forces caused by the significant driven speed and force exerted by movement of the movable die portion 11 toward the static die portion 15. Supporting the roller 94 between the first and second arms 24,26 increases the robustness of this support and substantially prevents the damage to the roller 94 caused by the extreme forces exerted during operation.

During operation, the primary actuator 14 operates to move the first and second arms 24,26, about the axis 19. However, in the event that the primary actuator 14 becomes inoperable, the roller 94 will contact the knife plate 96. The roller 94 will then move along the cam surface 98 to rotate the camshaft 20 from the released position to the bending position.

The rotary cam assembly of this invention ensures that the rotary cam member is properly positioned relative to the bending cam during operation regardless of the condition of the primary actuator. Movement of the bending cam and the rotary cam member 18 are coordinated, to provide the desired negative angle bend. The rotary cam member of this invention prevents undesirable contact conditions from occurring due to improper operation of the primary rotary cam member 18 actuator.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A rotary cam assembly comprising:
   - a rotary cam supported between first and second arms and movable between a bending and a released position;
   - a first actuator for moving said rotary cam between said bending position and said released position;
   - a failsafe device for moving said rotary cam to said bending position when said first actuator fails to move said rotary cam to said bending position, said failsafe device comprising a rotatable element supported between said first and second arms, and a second actuator applying force directly to said rotatable element for moving said rotary cam to said bending position.

2. The assembly as recited in claim 1, wherein said second actuator comprises a cam surface engageable with said rotatable element.

3. The assembly as recited in claim 1, wherein said second actuator comprises a hydraulic cylinder.

4. The assembly as recited in claim 1, wherein said second actuator comprises a pneumatic cylinder.

5. The assembly as recited in claim 1, wherein said second actuator comprises a gas cylinder.

6. The assembly as recited in claim 1, wherein said rotatable element comprises a roller supported on a shaft, said shaft supported at distal ends by said first and second arms.

7. The assembly as recited in claim 6, wherein said rotatable element comprises a ball.

8. The assembly as recited in claim 6, wherein said rotatable element comprises a block with a heel surface for engaging said second actuator.

9. The assembly as recited in claim 1, wherein said first and second arms comprise a radial surface supported on a corresponding radial support, said first and second arms rotatable on said radial support for moving said rotary cam to said desired position.

10. The assembly as recited in claim 9, wherein said first and second arms comprise corresponding slots and said rotatable element is supported on a pivot pin movable within said slots.

11. The assembly as recited in claim 10, wherein said rotatable element comprises a block rotatable about said pivot pin, and a guide channel for guiding said block.

12. The assembly as recited in claim 11, wherein said block comprises guide balls guiding within said guide channel.

13. A rotary cam assembly comprising:

a rotary cam movable between bending and released positions;

a first actuator for moving said rotary cam between said bending and said released positions; and a second actuator biasing said rotary cam toward said bending position for ensuring said rotary cam moves to said bending position regardless of a condition of said first actuator.

14. The assembly of claim 13, comprising first and second arms attached for rotation with said cam, and a rotatable element supported between said first and second arms.

15. The assembly of claim 13, wherein said second actuator applies a biasing force directly to said rotatable element.

16. The assembly of claim 15, wherein said second actuator comprises a gas spring.

17. The assembly of claim 13, comprising a pivot pin supporting said rotatable element between said actuator and said first and second arms.

18. The assembly of claim 17, wherein said first and second arms comprise corresponding slots and said pivot pin is movable within said slots.

19. The assembly of claim 18, comprising a guide block attached to said rotatable element to maintain a desired orientation to said second actuator.

20. The assembly of claim 19, wherein said guide block comprises guide balls moving within guide slots.

21. The assembly of claim 18, wherein said first and second arms include a radial bearing surface on which said first and second arms rotate for moving said cam to said bending position.

* * * * *